United States Patent [19]

Kline

[11] 3,995,796

[45] Dec. 7, 1976

[54] LANTERN HOLDER AND WASH PAN STAND DEVICE

[76] Inventor: George William Kline, 6 Evans Road, Chillicothe, Ohio 45601

[22] Filed: May 12, 1975

[21] Appl. No.: 576,683

[52] U.S. Cl. ..... 248/121; 248/461; 248/150; 248/156

[51] Int. Cl.[2] ..... A45F 3/44

[58] Field of Search ..... 4/166, 167, 170; 52/146, 148; 248/121, 122, 124, 125, 150, 156, 216, 220.5, 221, 312, 315, 461

[56] References Cited

UNITED STATES PATENTS

| | | | |
|---|---|---|---|
| 323,793 | 8/1885 | Copeland | 52/148 X |
| 989,773 | 4/1911 | Flockhart | 248/121 X |
| 1,002,260 | 9/1911 | Golden | 248/156 X |
| 1,366,872 | 1/1921 | Cantleberry | 248/124 |
| 1,452,640 | 4/1923 | Hulick | 248/121 |
| 1,666,293 | 4/1928 | Lorton | 248/156 X |
| 2,975,999 | 3/1961 | Bunch | 248/121 |
| 3,076,557 | 2/1963 | Husted et al. | 248/156 X |
| 3,249,383 | 5/1966 | Geller | 248/461 X |
| 3,285,554 | 11/1966 | Voelkerding | 248/156 X |
| 3,317,168 | 5/1967 | Ziph | 248/125 X |

FOREIGN PATENTS OR APPLICATIONS

| | | | |
|---|---|---|---|
| 1,045,986 | 7/1953 | France | 248/216 |
| 585,845 | 12/1924 | France | 248/220.5 |

*Primary Examiner*—Lawrence J. Staab
*Attorney, Agent, or Firm*—Marden S. Gordon

[57] ABSTRACT

A sectional post having its bottom end adapted to be inserted into the ground and having a hook projecting outwardly from its top end adapted to support a lantern therefrom, and a series of rings detachably mounted to the midsection of the post to provide a wash stand support and a towel ring support, and a soap dish detachably mounted to the mid section of the post adapted to hold a bar of soap. There is further provided detachable guide lines for stabilizing the post, and a pouch type carrying case for carrying all of the components of the stand except for a lantern.

1 Claim, 5 Drawing Figures

LANTERN HOLDER AND WASH PAN STAND DEVICE

BACKGROUND OF THE INVENTION

1. Field of the Invention

This invention relates generally to camping accessories and more particularly to a novel lantern holder and wash pan stand device which is collapsible for carrying purposes and which readily opens for use in any desired location at the camp site.

2. Description of the Prior Art

The popularity of camping as evidenced by sales of recreational vehicles, pop-up campers, and the like is constantly increasing among the general populace, with such campers requiring a variety of support accessories for camping conveniences.

One of the main difficulties in camping is the erection of an area at which washing and basic sanitary procedures may be followed, this being further complicated by the necessity of utilizing some type of lighting during the evening hours to increase visibility. Presently, most campers utilize makeshift arrangements using tables, benches and the like to make some type of temporary washing location.

SUMMARY OF THE INVENTION

The present invention recognizes the difficulties encountered in camping as to the establishing of a washing location for personal sanitation, and provides a novel solution thereto in the form of a lantern holder and wash pan stand device which is readily transported in a collapsed position to a desired location and then rapidly and efficiently erected at the desired location to provide a stand for a wash pan, soap and towel and lantern in a manner requiring no special tools, skills or expertise.

It is a feature of the present invention to provide a lantern holder and wash pan stand device which is relatively simple in its construction and which, therefore, may be readily manufactured at a relatively low cost and by simple manufacturing methods such that it can be retailed at a sufficiently low price to encourage widespread use and purchase thereof.

A further feature of the present invention provides a lantern holder and wash pan stand device which is easy to use and reliable and efficient in operation.

Still a further feature of the present invention provides a lantern holder and wash pan stand device which is of a rugged and durable construction and which, therefore, may be guaranteed by the manufacturer to withstand many years of intended usage.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figures 1, 2, 3, 4, 5:
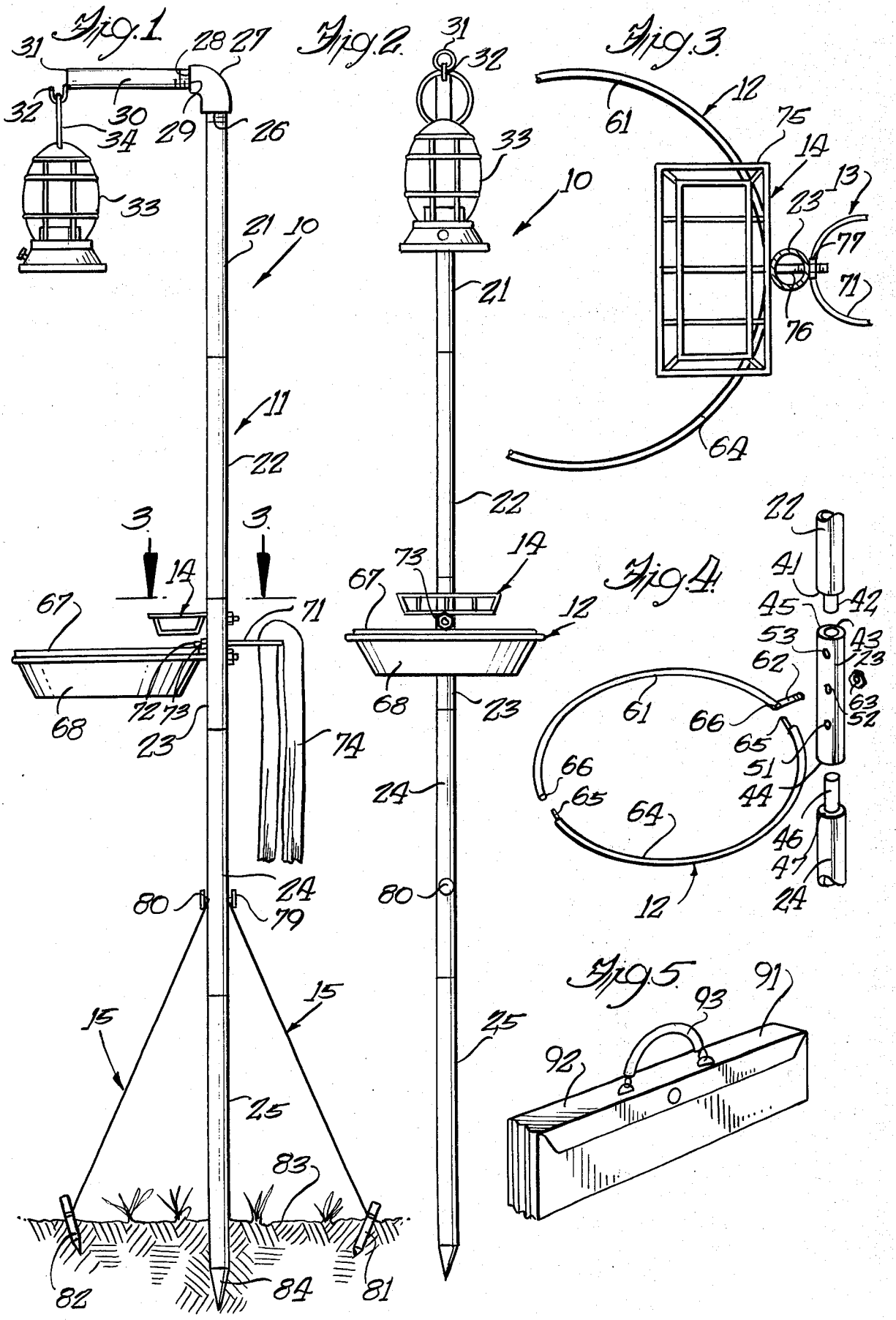
FIG. 1 is a side elevational view of the lantern holder and wash pan stand of the present invention.
FIG. 2 is a front elevational view of the invention.
FIG. 3 is an enlarged cross-sectional view taken along line 3—3 of FIG. 1.
FIG. 4 is a diagramatic perspective fragmentary view of a midsection of the invention.
FIG. 5 is a perspective view of the carrying case of the invention.

Referring now to the drawings in detail, there is illustrated a preferred form of a lantern holder and wash pan stand device constructed in accordance with the principles of the present invention and which is designated generally in its entirety by the reference numeral 10 and which is comprised of a post 11, wash pan ring 12, towel ring 13, soap dish 14, and detachable guide lines 15.

The post 11 is of a general telescopic construction formed of topmost cylindrical section 21 and 22, mid-cylindrical section 23, and bottom cylindrical sections 24 and 25. The top end 26 of section 21 is threaded and detachably received thereon one end of a 90° threaded nipple 27 having its opposite end 28 receiving therein end 29 of elongated cylindrically shaped extension rod 30 having terminal end 31 supporting a hook 32 therefrom, the hook adapted to support thereon a lantern 33 from its handle 34.

It is to be understood that while the sections 21–25 may be screwed or otherwise fastened to each adjacent section, that for ease of assembly and disassembly there is provided at the joint between sections 21 and 22 along with between sections 24 and 25 a combination pin and socket assembly with the socket being in the end of one of the sections and the pin being in the end of the other section such that each section may be readily plugged into each other section. This pin and socket combination is the same of that which will be henceforth described pertaining to midsection 23 as illustrated in FIG. 4.

The bottom end 41 of section 22 is provided with a cylindrical pin 42 extending longitudinally outwardly therefrom. The top end 43 and bottom end 44 of midsection 23 is each provided with a cylindrical socket 45 opening thereinto, with socket 45 in top end 43 adapted to receive pin 42 therein, and with bottom socket 45 and bottom end 44 adapted to receive pin 46 therein which projects longitudinally outwardly of top end 47 of section 24.

The midsection 23 is provided with three diametrically extending openings 51, 52 and 53 for use with wash pan ring 12, towel ring 13 and soap dish 14 as will be later described.

The towel ring 12 is formed of two components, the first being of a generally sicle shaped body member 61 having a threaded shaft 62 adapted to pass through one of the openings 51–53 and be secured thereto by knot 63. The second body member is of a semi-circular configuration and is identified by reference numeral 64 and is provided at its opposite ends with projecting pins 65 which are adapted to be inserted into mating opening 66 provided in body member 61 as illustrated in FIG. 4. Member 64 is thus readily attached to and detached from member 61 for ease of storage and use thereof. When member 64 is affixed to 61, there is provided a ring shaped member adapted to engage rim 67 of dish shaped wash pan 68 for supporting the same therein.

The towel ring 13 is formed of a solid ring shaped body member 71 provided with a threaded shaft extending diametrically outwardly therefrom adapted to pass through one of openings 51–53 and be secured therein by a nut 73. Towel ring 13 is of a diameter to readily receive therein a towel 74 as illustrated in FIG. 1.

The soap dish 14 is formed of a skeleton shaped rectangular open topped box-shaped body member 75 provided with a threaded shaft 76 affixed to a side thereof and extending outwardly therefrom to be received in one of openings 51–53 and be secured therein by means of a nut 77. The soap dish 14 is of a size and configuration to receive a bar of soap restingly therein.

To assist in stabilizing the post 11, there are provided a pair of detachable guide lines 15 manufactured of flexible cord and each having one end adapted to be tied about one of the boss members 79 and 80 extending from opposite diametric directions out of section 24, the opposite ends of the cord adapted to be secured to one of stakes 81 or 82 driven into the ground 83 for stabilizing the post. In this regard, it is to be noted that the bottom end 84 of section 25 is of a pointed configuration to assist in its penetration into the ground 83 when setting up the post 11 in the desired location.

As seen in FIG. 5, there is illustrated a carrying case 91 which is of a pouch type provided with cover 92 and handle 93 which is adapted to carry all of the components of the stand 10, other than lantern 33, between locations of usage as well as for storage of the stand during periods of non-use. The carrying case may be manufactured out of vinyl, flexible material, or any other suitable satisfactory material providing an aesthetically pleasing and refined appearance.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size and arrangement of parts may be resorted to without departing from the spirit of the invention, the scope of the novel concepts thereof, or the scope of the sub-joined claims.

Having thus described the invention, what is claimed is:

1. A portable stand device comprising, in combination:

a post member consisting of a first top most elongated cylindrical member having a top end and a bottom end, a second elongated cylindrical member having a top end and a bottom end, a third cylindrical member forming the mid-section of the post and having a top end and a bottom end, a fourth cylindrical member having a top end and a bottom end, and a fifth bottom most cylindrical member having a top end and a bottom end;

means detachable connecting the first post member bottom end to the second post member top end, the second post member bottom end to the third post member top end, the third post member bottom end to the fourth post member top end, and the fourth post member bottom end to the fifth post member top end, the means detachably mounting the adjacent ends of the post members to each other comprising a cylindrical socket formed in one of the member ends with a mating elongated cylindrical pin formed on the other of the member ends, the pin adapted to engage in the socket to detachably secure the adjacentmost post members together;

the first post top most member top end defining the top end of the post;

the fifth bottom most member bottom end being of an inverted conical shape defining a pointed bottom post end adapted to be stabbed into the ground supporting surface to secure the post in an upright position at the desired point of useage;

a pair of diametrically opposed outwardly projecting boss members affixed to the sides of the fourth cylindrical member;

a pair of stakes adapted to be driven into the ground at diametrically opposed sides of the post;

a pair of independent flexible cords each adapted to have one end tied to one of the boss members with their opposite ends adapted to be wrapped about projecting ends of the stakes to provide additional support to the post in the upright position;

an extension member having one end detachably affixed to the post top end with the free end thereof extending outwardly therefrom at a direction normal to the axis of the post and terminating a short distance outwardly therefrom;

a hook defining member affixed to the projecting free end of the extension member and adapted to hold a lantern suspended therefrom;

a series of three axially aligned openings spaced longitudinally apart from each other and extending diametrically through the third mid-section post member;

a wash pan supporting ring comprising a first body member of a general sickle shape having a semi-circular portion terminating at one end in a radially outwardly projecting threaded shaft adapted to pass freely through one of the third post member openings for detachably mounting the member to the post, a pair of circumferally disposed cylindrical sockets formed in the ends of the semi-circular portion of the body member and opening outwardly therefrom, and a semi-circular body member having pins extending circumferally outwardly from the opposite ends thereof adapted to be detachably received in the sockets of the sickle shaped first body member for forming therewith a circular ring shape;

a towel ring comprising a solid ring shaped body member, a threaded shaft having one end affixed to the body member with its opposite end extending radially outwardly therefrom and adapted to pass freely through one of the openings in the third post member, and a nut adapted to be threaded onto the threaded member to detachably secure the towel ring to the post;

a soap dish comprising an open skeleton frame type rectangular box-like configuration open at the top surface thereof, a threaded shaft affixed to one side of the rectangular box and extending outwardly therefrom in a direction normal thereto and adapted to pass freely through one of the openings in the third post member, and a nut adapted to be threaded onto the shaft to detachably mount the soap dish to the post; and an expandable carrying case formed of flexible material and including a lid and a handle and being of a size to carry all of the components of the portable stand in their collapsed positions between a storage location and a location of intended useage.

* * * * *